United States Patent [19]

Lisiecki

[11] 4,422,570

[45] Dec. 27, 1983

[54] FLAT TOP END CLOSURE FOR LIQUID CONTAINERS

[75] Inventor: Robert E. Lisiecki, Orchard Lake, Mich.

[73] Assignee: Ex-Cell-O Corporation, Troy, Mich.

[21] Appl. No.: 411,739

[22] Filed: Aug. 26, 1982

[51] Int. Cl.[3] ..... B65D 5/74

[52] U.S. Cl. ..... 229/17 R; 229/7 R

[58] Field of Search ..... 229/17 R, 7 R

[56] References Cited

U.S. PATENT DOCUMENTS

| | | | |
|---|---|---|---|
| 3,147,904 | 9/1964 | Larson | 229/17 R |
| 3,892,347 | 7/1975 | Egleston | 229/17 R |
| 4,078,715 | 3/1978 | Larsson | 229/17 R |
| 4,085,885 | 4/1978 | Lisiecki | 229/17 R |
| 4,124,159 | 11/1978 | Schwarzkay, Jr. | 229/17 R |

*Primary Examiner*—Herbert F. Ross
*Attorney, Agent, or Firm*—John P. Moran

[57] ABSTRACT

The drawings and description disclose a flat top end closure for a liquid carrying container, which does not include the usual, well-known gable top characteristics. The flat top end closure includes two oppositely disposed outer closure panels which are adapted to lie flat on top of the underlying fold-in panels and wherein one is longer and overlaps the edge portion of the other shorter one, with the longer one including a lift tab for lifting a portion of the pour spout from its flat attitude during the opening process, and two oppositely disposed, three-segment fold-in panels, one of which serves as the pour spout when opened and includes a lift tab on one of its segments for first lifting a portion of the pour spout from its flat attitude during the opening process, and then opening the full pour spout in such a manner that the pouring lip need not be handled. Each of the three-segment fold-in panels includes a substantially triangular panel portion defined by converging diagonal score lines extending from the upper edge of the tubular container body, and a pair of fold-back panels integrally connected to and folded between the substantially triangular panel portion and the respective adjacent outer closure panels. The above-mentioned lift tab is formed on one of the fold-back panels.

6 Claims, 10 Drawing Figures

FLAT TOP END CLOSURE FOR LIQUID CONTAINERS

TECHNICAL FIELD

This invention relates generally to thermoplastic coated paperboard containers and blanks for constructing same and, more particularly, to a folded flat top end closure therefor.

BACKGROUND ART

Containers for beverages such as milk and juices are conventionally constructed from thermoplastic coated paperboard. One common type of these containers includes a top end closure with a folded gable roof having a vertically projecting sealed fin at the roof ridge for sealing the container. Such containers are shown by U.S. Pat. No. 3,270,940. The bottom end closure for same in conventionally of the infolded type, such as that shown by U.S. Pat. No. 3,120,335.

Another type of container includes a slant top or a flat top end closure wherein what could otherwise be a vertically projecting sealed fin, or a slanted sealed fin, may be folded flat and releasably secured to the rest of the closure. U.S. Pat. Nos. 3,869,078 and 4,211,357 disclose such slant and/or flat top closures.

Various techniques have been employed to enhance the folding of a sealed fin in one particular direction to facilitate packing the containers in layers on top of each other to minimize storage and cargo space, without requiring any shipping tray between layers. For example, in U.S. Pat. No. 4,078,715 there is disclosed a top end closure with an inclined sealed fin that includes a "harder crease" on one side thereof than on the other for facilitating folding of the sealed fin from a vertical position to the inclined position.

U.S. Pat. Nos. 4,012,997 and 4,093,115 disclose a container folding method and the container made by the method, wherein one side of the gable panels of the top end closure is provided with double score lines extending parallel to each other. Folding of a sealed top fin of the end closure from a vertical position to a flat position requires the application of a downward force along the lower line of the double score line on one side of the sealed fin and the application of another force against the outside panel to bend the sealed fin downwardly.

In U.S. Pat. No. 4,206,867, a wide score line is formed on one side of the gable panels, in lieu of the above mentioned double score lines, with a conventional score line on the opposite side providing unequal fold-back panels on the two sides to facilitate folding the sealed top fin from a vertical position in a direction toward the smaller fold-back panels.

In the above-mentioned U.S. Pat. No. 4,211,357, unequal angles at the base of the infolded gable or gusset panels, with or without lower score lines on one side thereof than on the other, enhance folding in the direction of the larger base angles. In an alternative embodiment, a lowered and/or inclined wide score line provide the inclination to slant in one direction.

DISCLOSURE OF THE INVENTION

An object of the invention is to provide an improved flat top end closure for a liquid carrying, paperboard container, wherein the sealed fin previously used in conjunction with flat end closures is not required, but wherein a pitcher pour spout is included.

A further object of the invention is to provide an improved flat top end closure, including an external lift tab integrally formed on one outer closure panel for initial lifting of a portion of the pitcher pour spout, and an underlying lift tab formed on one fold-back closure panel of another portion of the pitcher pour spout, in order to facilitate dispensing the liquid contents of the container.

Still another object of the invention is to provide a flat top end closure for a container, including two oppositely disposed outer closure panels which are adapted to lie flat on top of the underlying fold-in panels and wherein one is longer and overlaps the edge portion of the other shorter one, with the longer one including a lift tab for lifting a portion of the pour spout from its flat attitude during the opening process, and two oppositely disposed, three-segment fold-in panels, one of which serves as the pour spout when opened and includes a lift tab on one of its segments for first lifting a portion of the pour spout during the opening process, and then opening the full pour spout in such a manner that the pouring lip need not be handled and rendered unsanitary.

These and other objects and advantages of the invention will be apparent when reference is made to the following description and accompanying drawings.

BEST MODE OF CARRYING OUT THE INVENTION

Figure 1:
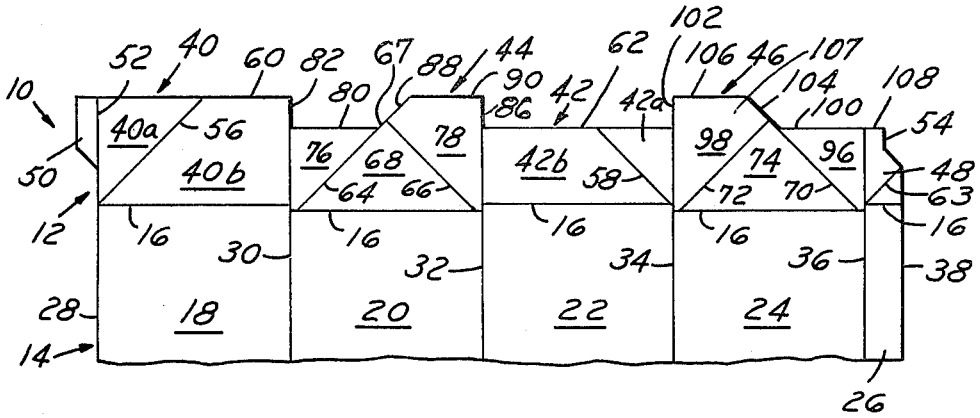
FIG. 1 is a fragmentary layout view of a blank from which the top end closure of the invention is formed, showing the outside surface thereof.

Referring now to the drawings in greater detail, FIG. 1 illustrates a blank 10 including a top closure portion and a body portion 14, separated by a staggered horizontal score line 16. The latter includes a first side panel 18, a back panel 20, a second side panel 22, a front panel 24, and a narrow fifth panel or side seam 26. The panels 18, 20, 22, 24 and 26 are defined, respectively, by a first free cut edge 28, vertical score lines 30, 32, 34, and 36, and a second free cut edge 38.

A pair of outer top panels 40 and 42 are integrally connected to the first and second side panels 18 and 22, respectively, at the score line 16. A pair of fold-in top panels 44 and 46 are integrally connected to the back and front panels 20 and 24, respectively, at the score line 16. The top panels are integrally connected to each other by the above-mentioned vertical score lines. An end closure extension 48 of the side seam 26 is integrally connected to the latter at the score line 16 and to the fold-in panel 46 at the score line 36. The panel 46 will serve as a pour spout, as will be explained.

A lift tab 50 is formed on the upper end of the free cut edge 28 so as to be integrally connected to the top panel 40 by a score line 52 extension of the edge 28. It may be noted that formation of each lift tab 50 produces a notch or cut-out in the adjacent blank such that each blank 10 includes a notch 54 formed in the upper portion of the extension 48 of the side seam 26.

Opening-assist diagonal score lines 56 and 58 are formed on the outer top panels 40 and 42, respectively, the line 56 extending substantially from the intersection of the edge 28 and the horizontal score line 16 to the free cut edge 60 of the panel 40, dividing the panel 40 into segments 40*a* and 40*b*, and the line 58 extending from the intersection of the score lines 34 and 16 to the free cut edge 62 of the panel 42, dividing the panel 42 into segments 42*a* and 42*b*. A diagonal score line 63 is formed on the extension 48 for cooperation with the diagonal score line 56 during subsequent folding operations.

A pair of converging diagonal score lines 64 and 66 are formed on the fold-in top panel 44. A short free cut edge extension 67 of the score 64 meets the score line 66 so as to form with the horizontal score line 16 a triangular panel portion 68 adjacent the upper edge of the body back panel 20. Likewise, a pair of converging diagonal score lines 70 and 72 are formed on the fold-in top panel 46 so as to form with the horizontal score line 16 a triangular panel portion 74 adjacent the upper edge of the body front panel 24. The score lines 64, 66, 70 and 72 are preferably spaced at their lower ends slightly inward from the respective adjacent vertical score lines 30, 32, 36 and 34 along the horizontal score line 16, but may intersect the junctures of score lines 30 and 16, 32 and 16, 36 and 16, and 34 and 16, respectively, if desired.

There remains on the panel 44 a pair of fold-back panel portions consisting of a short panel portion 76 between the score lines 64 and 30, a long panel portion 78 between the score lines 66 and 32. It may be noted in FIG. 1 that the free cut edge 80 of the panel portion 76 extends from the vertical score line 30 below the edge 60 to the diagonal score line 64 and its continuation edge 67, below the apex of the triangular panel portion 68. Hence, the extension of the vertical score line 30 is a short free cut edge 82.

The other fold-back panel portion 78 extends beyond the ends of the score line 32 and the apex of the triangular panel portion 68, such that it includes a short vertical free cut edge 86 aligned with the vertical score line 32, a short diagonal free cut edge 88 aligned with the diagonal score line 64, and a lateral free cut edge 90 extending between the outer ends of the edges 86 and 88. Thus, the panel portion 76 is substantially triangular in shape, defined by the score lines 30 and 64 and the edge 80, while the panel portion 78 is substantially four-sided in shape, defined by the score lines 32 and 66 and the edges 86, 88 and 90.

The fold-in panel 46 is the mirror image of the fold-in panel 44 and, hence, includes fold-back panel portions 96 and 98 comparable to the panel portions 76 and 78, respectively. Accordingly, the panel portion 96 is defined by the score lines 36 and 70 and a free cut edge 100 comparable to the free cut edge 80 of the panel 44. The panel portion 98 is defined by the score lines 34 and 72 and free cut edges 102, 104 and 106 comparable to the edges 86, 88 and 90 of the panel 44. However, the area of the panel portion 98 which is encompassed by the edges 102, 104 and 106 serves as a lift tab 107, as will be explained. A free cut edge 108 at the end of the side seam extension 48 aligns with the edge 100.

Figure 2:
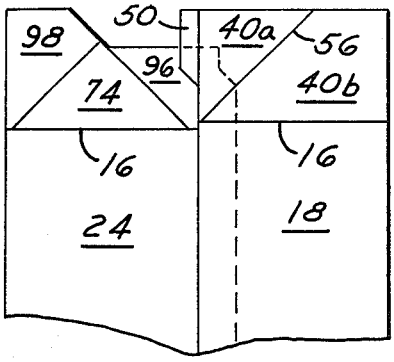
FIG. 2 is a fragmentary layout view of the outside surface of a blank after it is side seamed from the blank illustrated in FIG. 1.

The container blank 10 illustrated in FIG. 1 is formed into a side seam blank, as illustrated in FIG. 2, by rotating the body panel 24 and the side seam flap 26 as a unit about the vertical score line 34, and having the inside surfaces of the body panel 24 come into contact with the inside surface of the body panel 22, with the vertical score line 36 positioned next to the vertical score line 32, and with the inside surface of the body panel 20 adjacent the vertical score line 32. The body panel 18 is then rotated about the vertical score line 30 to bring its inside surface into contact with the outside surface of the side seam flap 26, and the edge 28 is positioned parallel and aligned with the vertical score line 36. The various members of the end closure 12 will make similar movements, and the container will appear as illustrated in FIG. 2. The container blank 10 is then sealed where the inside areas of the body panel 18 and the closure panel 40 come into contact with the outside surface of the side seam flap 26 and its extension 48.

Figure 3:
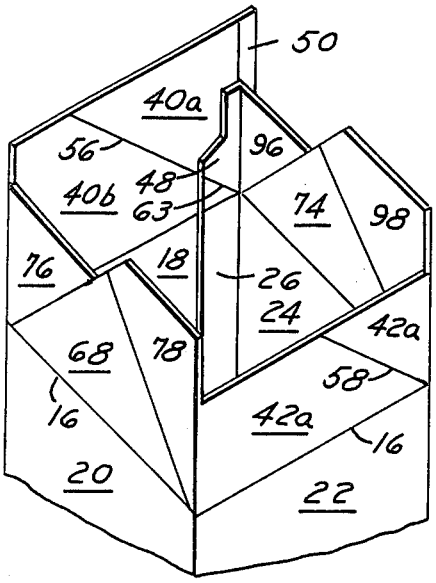
FIGS. 3, 4 and 5 are fragmentary perspective views illustrating sequentially various steps in forming the flat top end closure.
Figure 4:
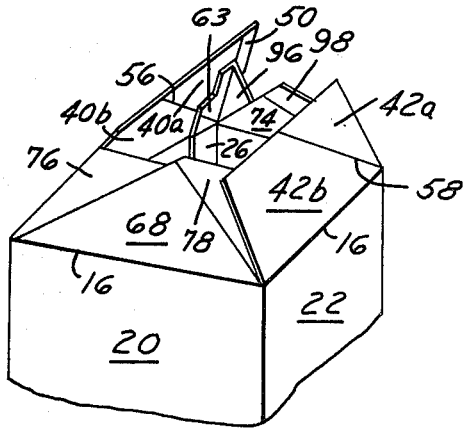

The next step in forming the side seam blank into a container is illustrated in FIG. 3. The side seam blank is opened up into a squared condition, after which the various parts of the end closure 12 are folded about the various score lines in the following manner. Then, as may be noted from FIG. 4, the triangular closure panels 68 and 74 are moved around the horizontal score line 16 over the end of the container toward each other. At the same time, the outer panels 40 and 42 are also moved toward each other about the horizontal score line 16. This causes the fold-back panel portion 76 to rotate around the vertical score line 30 such that the inside surfaces of the panel portion 76 and the outer panel 40 are approaching each other. At the same time, the panel portion 76 is moved around the diagonal score line 64 such that the outside surfaces of the panel portion 76 and the triangular closure panel 68 are approaching each other. The fold-back panel portions 78, 96 and 98 make the same movements as described for the panel portion 76, with respect to their adjacent panels 42 and 68, 40 and 74, and 42 and 74, respectively.

Figure 5:
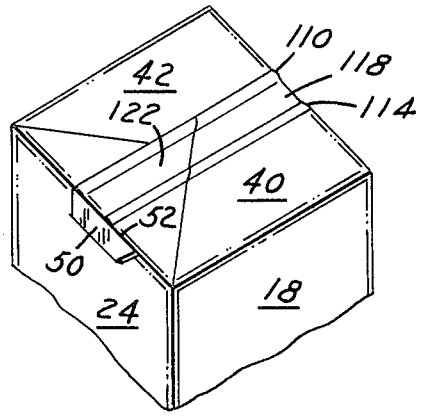
Figure 6:
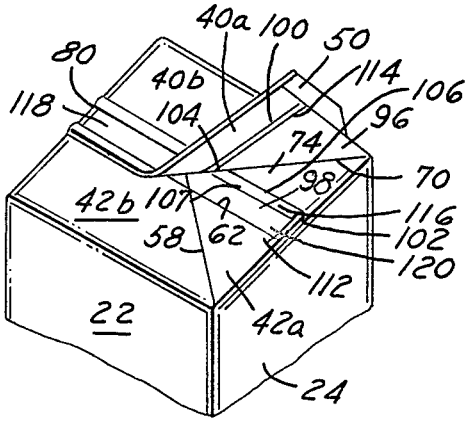
FIGS. 6 and 7 are fragmentary perspective views illustrating sequentially various steps in opening the flat top end closure into a pouring spout.

The shorter outer panel 42 and the adjacent longer fold-back panels 78 and 98 are caused to move just enough faster than the longer outer panel 40 and the adjacent shorter fold-back panels 76 and 96 such that the panel combination 42/78/98 is flattened before the overlying panel combination 40/76/96. The result, as shown in FIGS. 5 and 6, is that an edge portion 110 (FIG. 5) of the outer panel 40 overlaps and is sealed to the edge portion 112 (FIG. 6) of the outer panel 42, and the edge portions 114 of the panels 76 and 96 overlap and are sealed to the respective edge portions 116 of the panels 78 and 98. An intermediate strip portion 118 (FIG. 5) of the outer panel 40 is sealed to the strip portions 120 (FIG. 6) of the panels 78 and 98 which lies between the spaced free cut edges 62 and 100 (FIG. 6), and 62 and 80, tending to cause a full width impression 122 (FIG. 5) on the outside of the closed and sealed top closure.

The lift tab 50 (FIG. 5) may be bent downwardly about the score line 52 and sealed against the front panel 24 to accommodate shipping and stacking.

Figure 7:
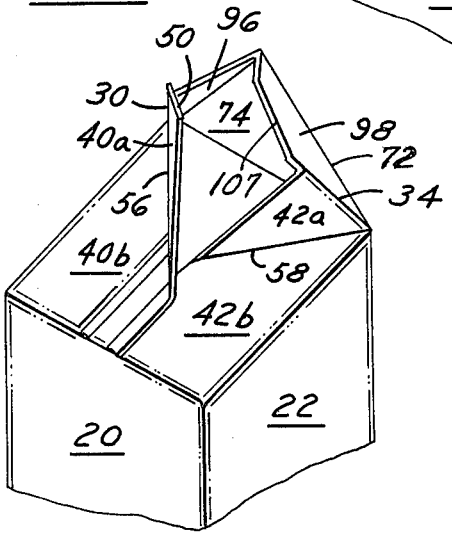

Referring now to FIG. 6, it may be noted that opening of the flat top closure is effectuated by first releasing the lift tab 50 from the front body panel 24 and then using the released tab to lift the outer roof panel segment 40*a* and the underlying panel portion 96 about the respective diagonal score lines 56 and 70, as shown in FIG. 6. This exposes the underlying portions of the panels 42*a* and 98, such that one may grasp the lift tab 107 formed by the edge portion of the panel 98, as defined by the free cut edges 102, 104 and 106. Thus, the panel segment 42*a* and the adjacent underlying portion of the panel portion 98, are lifted about the diagonal score lines 58 and 72, respectively. The pour spout shown in FIG. 7 is then opened as follows: the panel portions 74, 96 and 98 of the panel 46 are caused to assume a substantially planar attitude, whereupon pressure against the vertical edge score lines 34 and 36 tends to cause the triangular panel portion 74 to extend outwardly. However, in lieu of applying pressure to the edge score lines 34 and 36, the lift tab 107 may be used to lift the panel 98 and, hence, the triangular panel portion 74 and the panel 96 up into a planar attitude and then beyond, into the usual pitcher pour spout for dispensing the contents of the container. The pour spout may, of course, be generally reclosed after use.

To further facilitate the opening process, it may be desirable to apply an "abhesive" or anti-sealant pattern to appropriate outside and/or inside surfaces of the opening panel, as is well known in the art.

Figure 8:
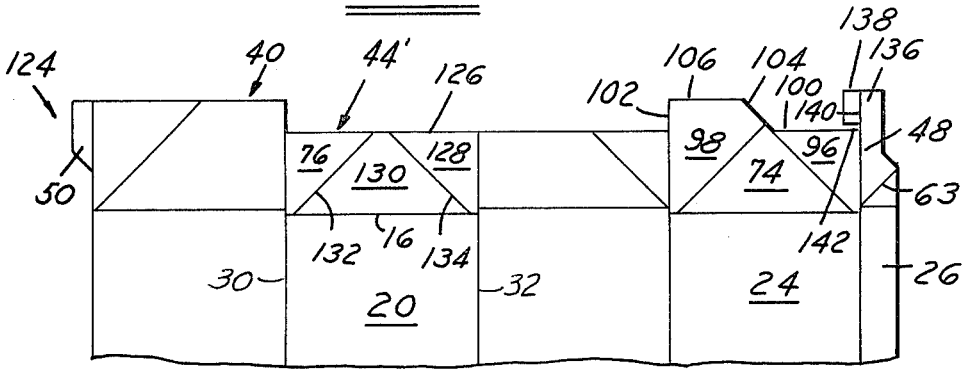
FIG. 8 is a fragmentary layout view of an alternate embodiment of the FIG. 1 arrangement.
Figure 9:
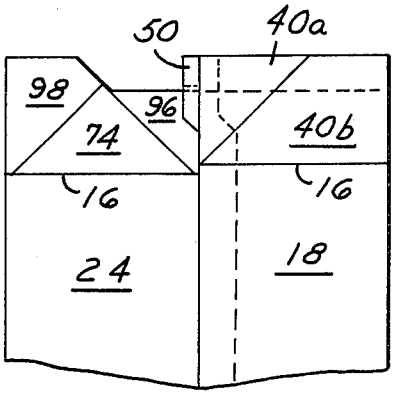
FIGS. 9 and 10 are respective fragmentary layout and perspective views comparable to FIGS. 2 and 3, but relative to the FIG. 8 structure.

An alternate container blank embodiment is shown in FIG. 8, wherein a blank 124 is similar in most respects to the blank 10 of FIG. 1, except that the panel 44 is rectangular in shape, defined by the score lines 16, 30 and 32, and a straight free cut edge 126. Hence, a short panel portion 128 replaces the long panel portion 78 of FIG. 1, such that panel portions 76 and 128 are symmetrical with respect to an intermediate panel portion 130 which is defined by the horizontal score line 16 and diagonal score lines 132 and 134. The score line 134 is shorter than the respective diagonal score line 66 of FIG. 1, and, hence, not triangular in shape but, rather, the apex of the triangular panel 68 of FIG. 1 is replaced by a central lateral portion of the free cut edge 126. This eliminates the possibility of any bind between the edges 90 and 80 of the FIG. 1 arrangement during the folding operations. In this case, the strip 118 of the outer panel 42 is sealed directly to a central portion of the panel 130.

Figure 10:
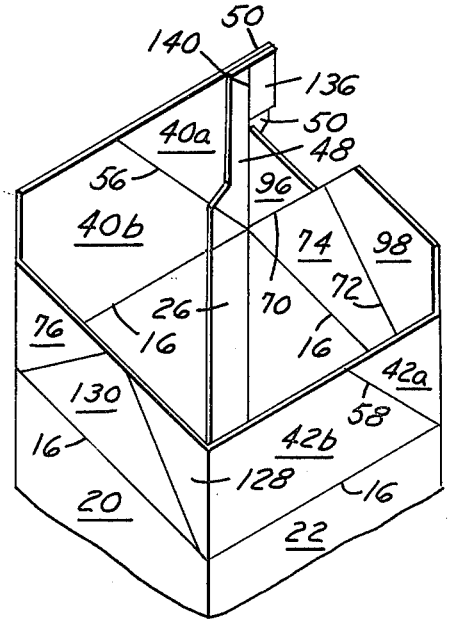

Additionally, an extension 136 is shown formed in part beyond the extension 48 of the side seam 26. A lateral extension 138 is connected to the extension 136 by a score line 140. The extensions 136 and 138 extend beyond the edge 100 of the panel portion 96 to a height equal to the height of the outer panel 40 to which it is secured during the sealing operation, as illustrated in FIG. 10. A cut line 142 separates the extension 138 from the panel portion 96 so that the extension 136 may remain secured to the lift tab 50, as shown in FIG. 10. The extension 138 serves, when sealed to the lift tab 50, to better lift the panels 40*a*, 48 and 96 as a unit without separation at the side seam. The extensions 136 and 138 could, of course, be adapted to the blank 10 arrangement of FIG. 1 as well.

INDUSTRIAL APPLICABILITY

It is apparent that the resultant flat top container may be stacked more readily during shipping and display than is the case with the conventional gable top container.

It should also be apparent that the flat top closure of the invention may be easily opened by virtue of the two lift tabs integrally formed thereon. While facilitating the opening process, use of the lift tabs eliminates any need to handle the pouring lip per se, thereby permitting the latter to retain its sanitary characteristics.

While but three embodiments of the invention have been shown and described, other modifications thereof are possible.

The embodiments of the invention in which an exclusive property or privilege is claimed are defined as follows:

1. A flat top end closure for a liquid carrying, paperboard container having a tubular body, said flat top end closure comprising two oppositely disposed fold-in panels, one of which serves as a pouring spout, and two oppositely disposed outer closure panels, said fold-in panels each including a substantially triangular panel portion defined by converging diagonal score lines and being integrally connected to said tubular body, and a pair of fold-back panels integrally connected to and folded between said substantially triangular panel portion and the respective adjacent outer closure panels, said two oppositely disposed outer closure panels including one shorter and one longer panel, with the edge portion of said longer panel overlapping said shorter panel, a lift tab formed on a side edge of said longer panel for lifting the portion of said longer panel which overlies said pouring spout and the one fold-back panel adjacent thereto, and a lift tab formed on the other of said fold-back panels for first lifting said other fold-back panel and the portion of said shorter closure panel which overlies said other fold-back panel and then opening the full infolded panel into a pouring spout.

2. A flat top end closure for a liquid carrying, paperboard container having a tubular body, said flat top end closure comprising two oppositely disposed fold-in panels and two oppositely disposed outer closure panels, said fold-in panels each including a substantially triangular panel portion defined by converging diagonal score lines and being integrally connected to said tubular body, and a pair of fold-back panels integrally connected to and folded between said substantially triangular panel portion and the respective adjacent outer closure panels, said two oppositely disposed outer closure panels including one shorter and one longer panel, with the edge portion of said longer panel overlapping the edge portion of said shorter panel and each having a diagonal opening assist score line formed thereon and overlying said respective converging diagonal score lines, a lift tab formed on a side edge of said longer panel for lifting the portion of said overlying longer panel adjacent its diagonal opening assist score line and the integrally connected underlying fold-back panel, and a lift tab formed on one of said fold-backpanels for lifting said fold-back panel and the portion of said overlying shorter closure panel adjacent its diagonal opening assist score line to enhance the opening of said underlying infolded panel into a pour spout.

3. The flat top end closure described in claim 2, wherein said last-mentioned lift tab also serves as a means for lifting the full fold-in panel bearing said lift tab and then for opening said fold-in panel into a pouring spout.

4. A blank for forming flat top end closure for a liquid carrying, paperboard container, said blank comprising four side panels, first and second pairs of top closure panels alternately connected by respective horizontal score lines to the top edges of said four side panels as extensions thereof, said first pair of top closure panels each including a substantially triangular panel portion defined by converging diagonal score lines, and a pair of fold-back panels integrally connected to and folded between said substantially triangular panel portion and the respective adjacent panel of said second pair of top closure panels, said second pair of top closure panels including one shorter and one longer panel, a diagonal opening assist score line formed on each of said shorter and longer panels, a lift tab formed on a side edge of said longer panel adapted to serve as a lift tab for the portion of said longer panel adjacent its diagonal opening assist score line and the integrally connected fold-back panel, and a lift tab formed on one of said fold-back panels adapted to serve as a lift tab for said fold-back panel and the portion of said shorter closure panel adjacent its diagonal opening assist score line once the blank has been sealed into a liquid carrying container and in the process of being opened.

5. The blank described in claim 4, wherein said lift tab formed on said one of said fold-back panels includes a vertical edge, a lateral edge and an edge which is a continuation of one of said converging diagonal score lines.

6. The blank described in claim 4, and a side seam formed adjacent one of said four side panels, an end closure extension formed at the top edge of said side seam adjacent one of said first pair of top closure panels, and an extension formed on the end of said end closure extension and adapted to cooperate with said first-mentioned lift tab during the sealing and opening operations.

* * * * *